United States Patent [19]

Heftler et al.

[11] 4,222,563

[45] Sep. 16, 1980

[54] PADDLE FOR PLAYING PLATFORM TENNIS, PADDLE BALL AND THE LIKE

[76] Inventors: Thomas E. Heftler; Lois L. Weinroth, both of 440 E. 79th St., Apt. 9G, New York, N.Y. 10021

[21] Appl. No.: 25,673

[22] Filed: Mar. 30, 1979

[51] Int. Cl.[3] ..... A63B 69/38

[52] U.S. Cl. ..... 273/67 R; 273/29 A; 273/374

[58] Field of Search ..... 273/26 R, 26 A, 26 B, 273/29 R, 29 A, 29 B, 67 R, 67 B, 72 R, 76, 73 R, 73 C, 73 D, 162 R, 181 R, 181 E, 181 J, 183 R, 186 R, 186 A, 102.1 R, 102.1 B, 102.1 C, 102.2 R, 102.2 A, 102.2 B, 102.2 C

[56] References Cited

U.S. PATENT DOCUMENTS

| | | | |
|---|---|---|---|
| 2,247,501 | 7/1941 | Jenks et al. | 273/181 J |
| 2,736,557 | 2/1956 | Androsiglio | 273/102.1 C X |
| 2,784,001 | 3/1957 | Simjian | 273/102.2 R X |
| 3,367,661 | 2/1968 | Dean | 273/181 E X |
| 3,880,427 | 4/1975 | Bingham | 273/102.2 R X |
| 4,101,132 | 7/1978 | Conrey et al. | 273/29 A |

FOREIGN PATENT DOCUMENTS

| | | | |
|---|---|---|---|
| 489924 | 1/1953 | Canada | 273/102.2 R |
| 2544853 | 4/1977 | Fed. Rep. of Germany | 273/73 R |
| 46109 | 2/1929 | Norway | 273/102.2 |
| 442218 | 1/1936 | United Kingdom | 273/102.2 R |

*Primary Examiner*—Richard J. Apley
*Attorney, Agent, or Firm*—Kenyon & Kenyon

[57] ABSTRACT

A paddle or bat for hitting a ball has a head formed by a rigid layer, a network of open mesh strands on the layer and an elastically deflectable sheet in front of the network and forming a surface for hitting a ball. When a ball is hit, the sheet deflects through the network and engages the base layer's front surface. The contact between the parts and its location can be used to actuate a signal for indicating a score.

5 Claims, 6 Drawing Figures

PADDLE FOR PLAYING PLATFORM TENNIS, PADDLE BALL AND THE LIKE

BACKGROUND OF THE INVENTION

A paddle of the type used for playing platform tennis, paddle ball and the like, normally comprises a handle connected to a flat head for hitting the ball. This head is characteristically a piece of plywood or the like, possibly having a layer of facing material adhesively secured to the plywood. The head is rigid and solid throughout and has a characteristic feel which is considered to be desirable.

Normally the front or hitting face of the paddle head is plain. Enjoyment of the game played normally depends on the accuracy and skill with which the ball is batted back and forth. In some instances, the ball is tethered to the paddle by an elastic cord so that a single player can test his skill without having a companion.

The precision with which the ball is hit by the paddle is unknown to the player or players; only the result obtained is known for certain. The fun of play could be increased if the precision of hitting could be included into the overall scoring which has heretofore been dependent solely on the accuracy with which the ball is sent towards an opponent or back to the paddle if the elastic strand is used.

The desirability of the concept of knowing the precision with which a paddle or bat is used to hit a ball squarely and accurately has been recognized by the prior art. For example, the Miller U.S. Pat. No. 1,184,863, May 30, 1916, discloses a bat which provides a counter or score when the bat is struck fairly in the middle by a ball. However, this is done by using a plunger reciprocatively arranged in the center of the head of the paddle or bat and which interferes with usage by anyone who has become skilled in the use of the conventional solid-feeling paddle or bat used in what has become highly sophisticated gamesmanship exemplified by platform tennis in particular, but also in connection with other games using a paddle of the type having a solid relatively unyielding head as contrasted to the strings of the head of a tennis racket.

DESCRIPTION OF THE INVENTION

With the above in mind, the present invention is a paddle of the type described comprising a handle connected to what can appear to be and feel like the usual or standard flat head for hitting the ball. However, the difference is that this head comprises a substantially rigid base layer, which can be made of plywood or solid wood, with its front surface covered by a network of open mesh strands over which an elastically deflectable sheet is positioned. These parts can be made in the form of a laminate tightly connected together and having the typical feel of the usual paddle flat head.

The elastically deflectable sheet should have a degree of elasticity such that any portion locally receiving a ball impact locally springs backwardly momentarily through the mesh of the network so that the back surface of this front sheet contacts the front surface of the base layer. With the network made very thin, the sheet deflection can be kept very small so the usual solid feel is obtained when hitting balls. Such contact can be used for activating a signal which can be fed to a counter or the like for keeping score, and if a means is provided for activating the signal dependent on that portion receiving the ball impact, the precise location of the impact can be included in the scoring.

Such a means is provided by making the network electrically non-conductive, the elastically flexible sheet with an electrically conductive back surface and the base layer's front surface with one or more electrically conductive portions electrically insulated from each other. In this way, one or more electric switches are provided, each being a normally open switch but momentarily closing when a ball impacts with a portion of the front or deflectable sheet, which portion registers with the conductive portion of the base layer's front surface. There can be only one conductive portion on the base layer's front surface, centrally located with respect to the paddle head's contour. Preferably there is more than one such portion, in each instance there being formed the electric switch concept, each switch being connected to operate a counter which can either register cumulatively the portions where the ball impacted, or selectively so that there is a counter as to each portion.

For example, assuming that the typical pattern of a shooter's target is adopted, the central portion could provide the highest score, a first circle around this portion a lower score, and a circle around all representing the lowest score, each portion being electrically insulated from the other. When a ball impacts any portion, there can be a momentary closing of an individual circuit providing a signal feeding, for example, a digital counter that is electrically responsive and which is preferably located in the paddle handle and visible through a window in the handle.

Because of the laminate construction, as previously indicated, all layers can be integrated together tightly to provide the feel of the conventional paddle or bat and with which both skilled and unskilled players have become familiar. Playing technique is not interfered with in any way. The rigid base layer can have its conductor portions positioned on its front surface by the printed circuit technique with these portions being of extreme thinness. The electrically non-conductive network on this can itself be of strands which are very thin, such as being fine plastic strands. The interspacing or mesh should be open enough to permit the required backward deflection of the elastically deflectable front sheet which itself can be made of relatively thin plastic, for example. The spacing between the conductive back of the deflectable front sheet and the conductive pattern on the front of the base layer can be extremely small. To accommodate backhand strokes of the paddle, the other side of the base layer can be similarly provided with the described components, in which case the base layer becomes, in effect, the paddle head core. The paddle head need be no thicker than is usual.

DESCRIPTION OF THE DRAWINGS

The presently preferred mode for carrying out this invention is illustrated by the accompanying drawings, in which.

DETAILED DESCRIPTION OF THE DRAWINGS

Figure 1:
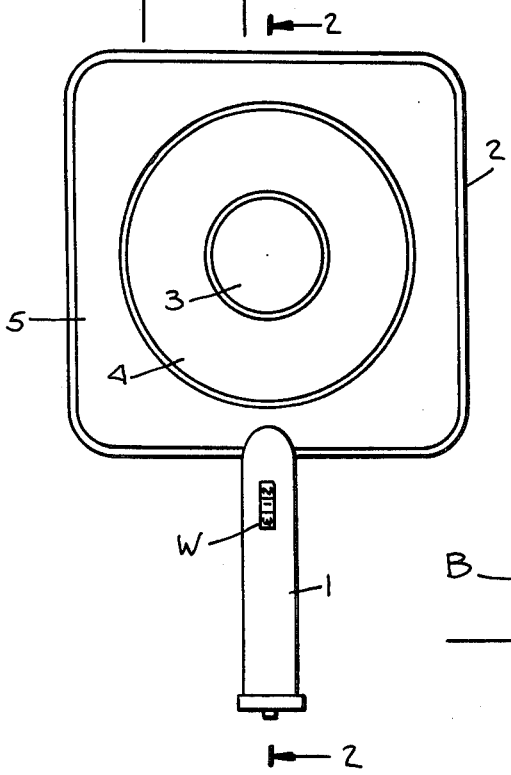
FIG. 1 shows one of the sides of the new paddle or bat.

In FIG. 1 the new paddle is shown with its handle 1 and head 2 and having its head face or striking surface printed to indicate in this case a shooter's target pattern, it being understood from the foregoing that behind each of the patterns 3, 4 and 5 there will be the corresponding conductive portions on the face or faces of the rigid base layer or core. Any desired pattern or patterns can be used.

Figure 4:
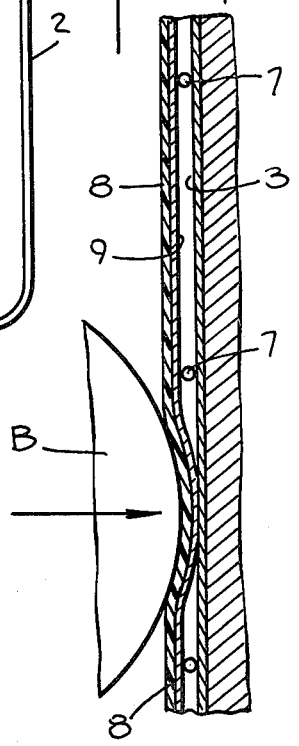
FIG. 4 is a section of the paddle head showing the operation involved when hitting a ball.
Figure 2:
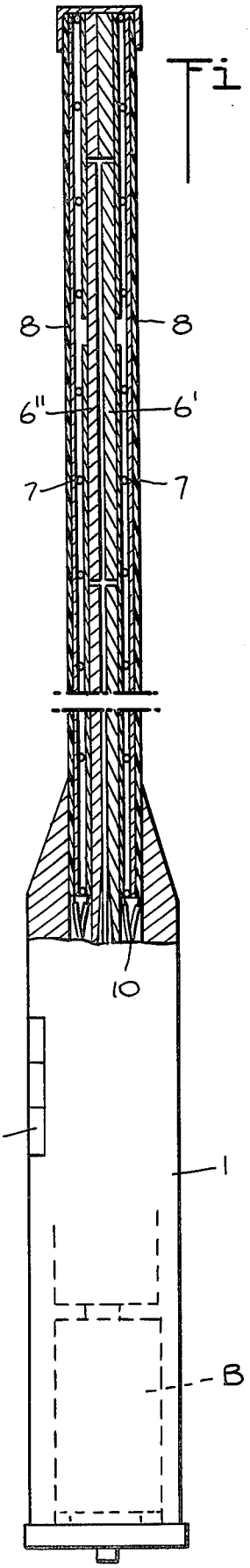
FIG. 2 is a longitudinal section taken on the line II—II in FIG. 1.

In the other figures, this base layer is shown at 6 with its pattern of electrically conductive printing, here using printed circuitry to provide an example, indicated at 3', 4', and 5'. The network of open mesh strands is shown at 7, and as illustrated by FIGS. 2 and 4, this is placed directly against the base layer and the printed circuit elements. The network can be adhesively fixed to these parts.

Figure 3:
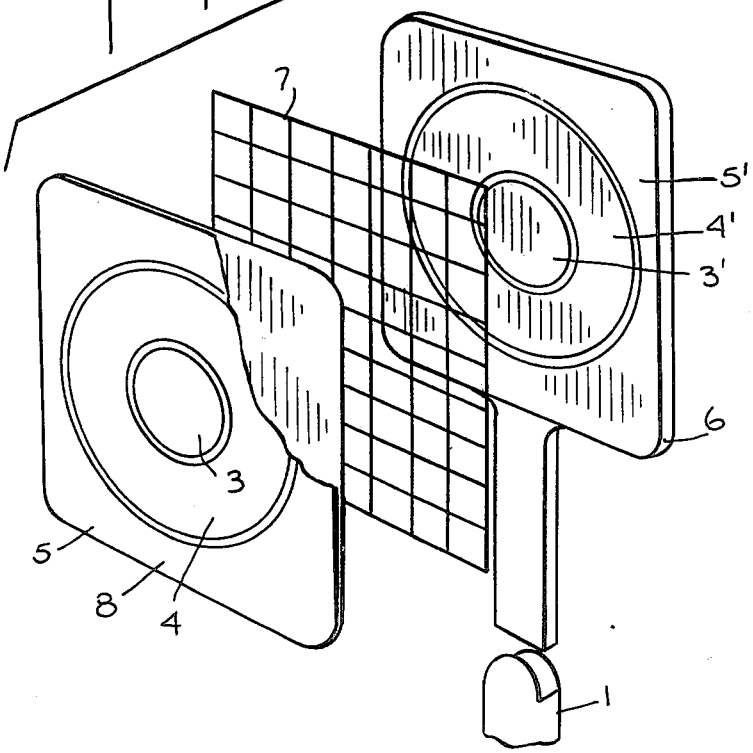
FIG. 3 is an exploded view showing the various components.

This network 7 can have various patterns but it must, of course, be made of electrically non-conductive material, such as thin strands of plastic. The network can be interwoven strands or possibly more preferably a very thin sheet of plastic provided with openings. The mesh or openings must be open enough for penetration by the elastically deflectable cover or front sheet, indicated at 8 in FIGS. 2 through 4. This front or cover sheet 8 can have an electrically conductive inner surface 9, provided in various ways. One example is to provide the sheet 8 with a very thin inner layer of foil which if adhesively secured firmly to the sheet should not fragment during playing. Possibly more preferably the inner surface of the sheet 8 can have electrically conductive material bonded to the sheet, assuming the sheet to be plastic. It is possible for the entire sheet 8 to be made of conductive material such as a thin sheet of aluminum, although for aesthetic reasons it might be more desirable to have the face or front of the sheet 8 look as it usually does.

For illustrative purposes, FIGS. 2 and 4 show an exaggerated thickness of the various parts. The advantage of this exaggeration is provided by FIG. 4 which clearly indicates how a ball B hit by the paddle head deflects the sheet 8 inwardly or backwardly so its electrically conductive inside 9, by deflection of the sheet, comes into contact with one or another of the electrically conductive portions, such as 3 in FIG. 4, to act like an electric switch. The interspacing of the strands of the electrically insulating network 7 should be proportioned to permit the required penetration of the sheet 8. The sheet deflection can be very small if the network is made very thin.

The portions 3', 4' and 5', in this case, each provide for an electric circuit for actuating a counter in the handle 1 which can be seen in FIG. 1 as visually exposed through a window W. Assuming that the conductive layer 9 is taken as electrical ground or earth, the outermost portion 5' can be connected to apparatus positioned in the handle 1 via wires 9 as indicated by FIG. 2 which illustrates the paddle as having both sides provided with the described components to accommodate backhand strokes. In the case of the portions 3 and 4, the wiring for these may be run down internally through the rigid base layer 6. An easy way to do this is, as shown by FIG. 2, by making this rigid layer from two pieces of wood or plastic, these pieces being shown at 6' and 6'' in FIG. 2, the wiring being sandwiched between the pieces and the latter then rigidly laminated together by suitable adhesive to provide what is, in effect, a rigid piece of plywood or plastic. Individual circuits extend from the portions 3', 4' and 5' into the handle 1 where the visible counter is positioned.

Figure 5:
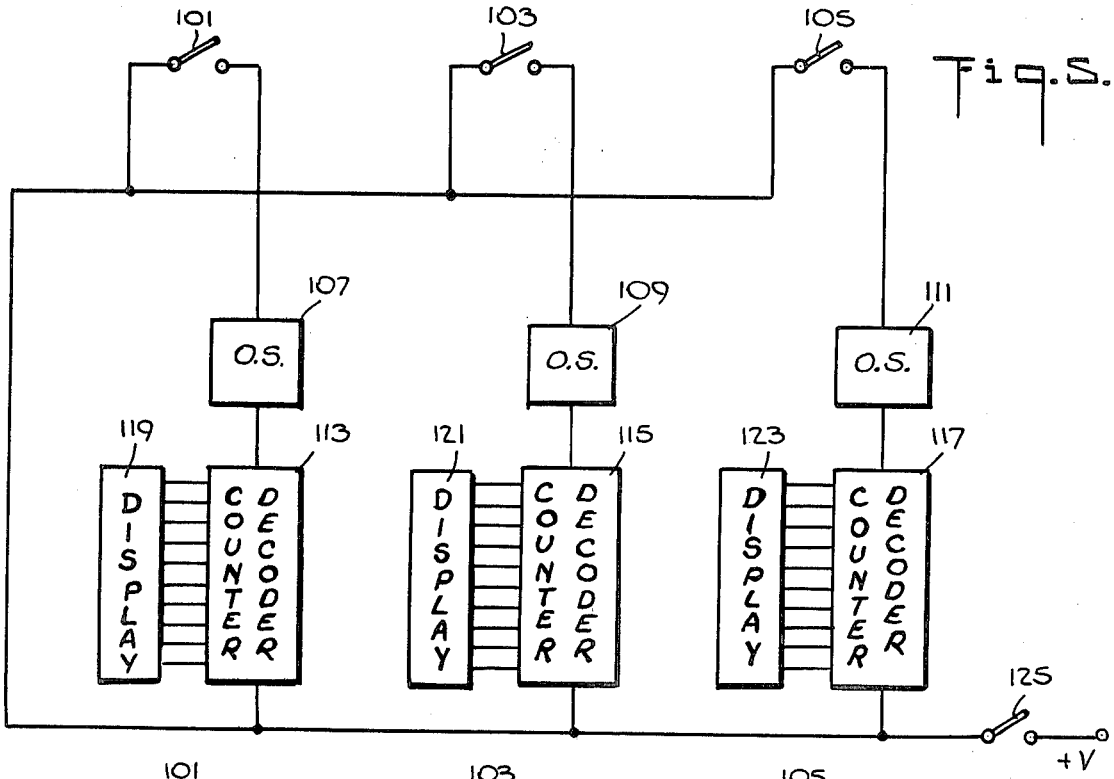
FIGS. 5 and 6 give examples of suitable circuitry.

Although any electrically actuated counter could be used, the reliability and flexibility of solid state circuitry is preferred. This can be provided in any prior art manner, examples being provided by FIGS. 5 and 6 as described below:

FIG. 5 is a circuit block diagram of a first embodiment of a circuit which can be used in the present invention. Shown are switches 101, 103 and 105 representing the inner, middle and outer areas on the paddle. The output of each switch is the input to a one-shot multivibrator used for the purpose of eliminating contact bounce and for pulse shaping. Thus, the output of switch 101 is the input to a one-shot multi-vibrator 107, the output of switch 103, the input to a one-shot multivibrator 101, and the output of switch 105 the input to a one-shot multi-vibrator 111. The one-shot multi-vibrator outputs are inputs respectively to counter and decoder modules 113, 115 and 117. Each of the modules 113, 115 and 117 is a circuit including a binary counter and binary to seven segment decoder. The outputs of the modules 113, 115 and 117 are fed to respective seven segment displays 119, 121 and 123. These displays may be conventional LED or liquid crystal displays visible through the window W. Also shown on the figure is a switch 125 for power from a battery B shown in FIG. 2 to the various circuits and to the switches 101, 103 and 105, i.e., an on-off switch. With this embodiment the display 109 will thus indicate the number of hits in the middle of the paddle, the display 121 the number of hits in an intermediate area, and the display 123 the number of hits at the outside of the paddle.

Figure 6:
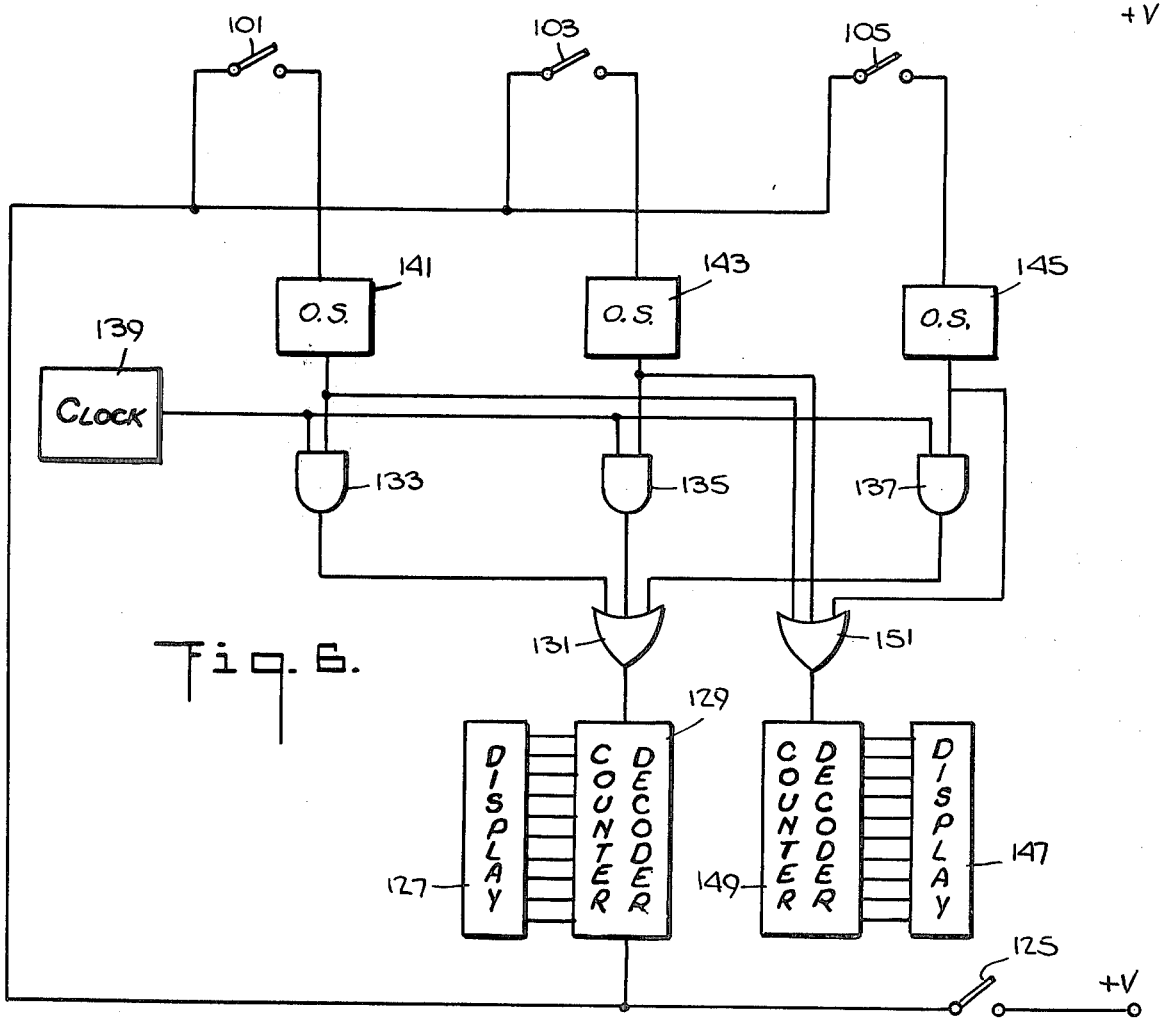

FIG. 6 illustrates a second embodiment of a circuit which can be used with the present invention. As in the embodiment of FIG. 5, switches 101, 103 and 105 are provided, as is on-off switch 125. However, in this embodiment only a single display 127 driven by a single counter and decoder 129 is provided. Counter and decoder 129 receives its input from an OR gate 131 which in turn has inputs from three AND gates 133, 135 and 137. Each AND gate has as one input the output of a clock 139. AND gate 133 receives its second input from a one-shot multi-vibrator 141 which is triggered by switch 101. AND gate 135 receives its output from a one-shot multi-vibrator 143 triggered by switch 103, and AND gate 137 receives its input from a one-shot multi-vibrator 145 triggered by a switch 105. The respective one-shot multi-vibrators 141, 143 and 145 enable their respective AND gates to permit a predetermined number of clock pulses to pass therethrough, through OR gate 131 and into the counter of module 129. The length of the output pulse of each one-shot multi-vibrator is preselected in conventional fashion, i.e., by means of an external capacitor. The one-shot multi-vibrator 141 associated with switch 101 at the center of the paddle will have the longest output pulse; for example, a pulse which will permit ten clock pulses to be gated into the counter. The one-shot multi-vibrator 143 associated with the switch 103 will have a shorter output pulse, for example, of a length to permit five pulses to be gated into the counter. Finally, a one-shot multi-vibrator 145 will have the shortest output pulse permitting, for example, only one or two pulses to be gated into the counter. Thus, in this embodiment the output of the display 127 will be an overall score with each hit weighted, hits in the center being weighted more heavily than hits towards the outside. In this manner the user can compare his scores from game to game or can compete with his opponent based upon how well he is achieving the object of hitting the higher scoring areas of the paddle's front surface.

Since the number of hits made in a given game may vary, this embodiment may also include an additional display for displaying the total number of hits. Such a display 147, fed by a counter and decoder 149, is also shown on FIG. 6. The inputs to the counter of the counter and decoder module 149 are obtained through an OR gate 151 which receives as inputs the outputs of the one-shot multi-vibrators 141, 143 and 145. With this modification, the user can then divide his total score as displayed on display 127 by the number of hits displayed on display 147 to obtain an average score. Alternatively, the system can include a digital divider for automatically dividing and displaying the average score.

What is claimed is:

1. A paddle of the type used for playing platform tennis, paddle ball and the like, and which comprises a handle connected to a flat head for hitting a ball, said head comprising a substantially rigid base layer having a front surface, a network of open mesh strands in front of said surface and connected to said layer, an elastically deflectable sheet in front of said network and connected to said layer, said sheet having a degree of elasticity such that any portion locally receiving a ball impact locally springs backwardly momentarily through the mesh of said network so that its back surface contacts said front surface, and means for activating a signal via contact between said surfaces.

2. The paddle of claim 1 in which said network is electrically non-conductive, said sheet has an electrically conductive back surface, the base layer's said front surface has at least one electrically conductive portion and forms with said conductive back surface an electric switch which is normally open and momentarily closing when a ball impacts with a portion of said sheet which registers with said conductive portion of the base layer's front surface, and an electric signal circuit activated by said momentary closing.

3. The paddle of claim 2 in which said network and sheet are tightly connected to said rigid base layer so that said head has the playing feel of a solid-headed paddle.

4. The paddle of claim 2 in which the base layer's said front surface has a plurality of said elastically conductive portions electrically insulated from each other so as to form a plurality of said electric switches with each switch having an electric signal circuit activated by momentary closing of the switch.

5. The paddle of claim 4 in which said handle has an externally visible digital counter activated by said switches.

* * * * *